US008925461B2

(12) United States Patent
Andersen et al.

(10) Patent No.: US 8,925,461 B2
(45) Date of Patent: Jan. 6, 2015

(54) LOW PROFILE IGNITER

(75) Inventors: Mark Andersen, Joplin, MO (US); Steve Brandon, Miami, OK (US); Jim Ferraro, Baxter Springs, KS (US); James Kelley, Pineville, MO (US); Grant Tollefson, Joplin, MO (US)

(73) Assignee: Eaglepicher Technologies, LLC, Joplin, MO (US)

( * ) Notice: Subject to any disclaimer, the term of this patent is extended or adjusted under 35 U.S.C. 154(b) by 0 days.

(21) Appl. No.: 13/472,027

(22) Filed: May 15, 2012

(65) Prior Publication Data

US 2013/0074722 A1 Mar. 28, 2013

Related U.S. Application Data

(60) Provisional application No. 61/537,880, filed on Sep. 22, 2011.

(51) Int. Cl.
*F42B 3/103* (2006.01)
*F42B 3/12* (2006.01)

(52) U.S. Cl.
CPC ..... *F24B 3/127* (2013.01)
USPC ..... 102/202.7; 102/202.14

(58) Field of Classification Search
USPC ..... 102/200, 202.5, 202.7, 202.8, 202.9, 102/202.14, 205
See application file for complete search history.

(56) References Cited

U.S. PATENT DOCUMENTS

| | | | | |
|---|---|---|---|---|
| 1,901,469 | A | 3/1933 | Piccard | |
| 5,423,261 | A | 6/1995 | Bernardy et al. | |
| 5,596,163 | A * | 1/1997 | Caflisch et al. | 102/202.2 |
| 5,603,525 | A * | 2/1997 | Zakula | 280/737 |
| 7,357,083 | B2 * | 4/2008 | Takahara et al. | 102/530 |
| 7,730,837 | B2 * | 6/2010 | Lahitte et al. | 102/202.12 |
| 2003/0150348 | A1 | 8/2003 | Furusawa et al. | |

FOREIGN PATENT DOCUMENTS

| | | | |
|---|---|---|---|
| EP | 2 573 502 | A2 | 3/2013 |
| WO | WO 2006/045726 | A1 | 5/2006 |
| WO | WO 2011/096872 | A1 | 8/2011 |

OTHER PUBLICATIONS

Nov. 19, 2013 Office Action issued in Japanese Patent Application No. 2012-190504 (with statement of relevance).

Jun. 2, 2014 Extended European Search Report issued in European Patent Application No. 12185154.7 (with Abstract).

* cited by examiner

*Primary Examiner* — James S Bergin

(74) *Attorney, Agent, or Firm* — Sutherland Asbill & Brennan LLP

(57) ABSTRACT

An igniter includes a housing having a first end with an opening, a second end opposite the first end, a longitudinal axis extending from the first end to the second end, and a top surface with a weakened area. The igniter may further include a pyrotechnic material disposed within the housing, a header having a first end and a second end opposite the first end, and a bridge element provided on the first end of the header and having lead wires on the second end of the header. The first end of the header may be inserted into the opening of the housing in a first direction so as to force the header against the pyrotechnic material. Flow of current through the bridge element heats the bridge element and ignites the pyrotechnic material, which causes the weakened area to rupture.

19 Claims, 5 Drawing Sheets

LOW PROFILE IGNITER

This non-provisional application claims the benefit of U.S Provisional Application No. 61/537,880, filed Sep. 22, 2011.

BACKGROUND

This disclosure relates to improved pyrotechnic igniters. In particular, this disclosure relates to pyrotechnic igniters usable, for example, to ignite a pyrotechnic material and, in turn, cause the heating of energetic devices such as thermal batteries. The invention, however, is not limited to use with thermal batteries, but is applicable to various situations in which a pyrotechnic igniter may be useful in generating heat and/or pressure.

Pyrotechnic igniters are devices containing a pyrotechnic material that is ignited causing a chain reaction resulting in the expulsion of hot gases and/or particles from the igniter. The expelled hot gases and/or particles are then used to ignite a later stage of a pyrotechnic train or to perform work.

The pyrotechnic material is often ignited via electrical initiation. In particular, electrical pyrotechnical initiators are initiators that use a bridge (a resistance element), which heats up by electrical current passing through the bridge, in order to ignite the pyrotechnic material. An example of a pyrotechnic initiator is the coin-shaped electrical pyrotechnic initiator illustrated in FIG. 1.

The coin-shaped initiator 1 of FIG. 1 includes a circular housing 2 having a top opening 12 and a disc closure 3 that covers the top opening 12 after a non-conductive ignitable material 4 and conductive ignitable material 5 have been loaded into the housing 2. Lead wires 6 are inserted in the Y-direction 10 into the housing 2. A glass/metal seal 8 surrounds the lead wires 6 entering into the housing 2. A bridge element (not shown) is disposed within an interior, bottom portion of the housing 2. The non-conductive material 4 is loaded within the interior of the housing 2. Further, the non-conductive material 4 is loaded into the housing 2 in an X-direction 9 perpendicular to the Y-direction 10. Specifically, the non-conductive material 4 is loaded into the housing 2 via the top opening 12. The conductive material 5 is loaded into the housing in the same X-direction 9 as the non-conductive material 4 and on top of the non-conductive material 4. Additionally, a weakened area 11 is formed in a top surface 13 of the disc closure 3. In the coin-shaped igniter, current is conducted via the lead wires 6 through the bridge element 7. The bridge element (usually a metal wire or foil) heats up due to its resistance, causing the non-conductive material 4 and the conductive material 5 to ignite. A pressure increase caused by ignition of the materials 4, 5 causes the weakened area 11 to rupture in the X-direction 9 (rupture direction 14), which is perpendicular to the Y-direction 10.

The non-conductive (electrically-isolative) material 4 is provided in contact with the bridge element to electrically isolate the bridge element from the housing 2 and the disc closure 3 so that any charge (including electro-static charge) inadvertently applied to the external housing (including the disc closure 3) does not unintentionally cause the bridge element to heat up. For example, if only electrically conductive ignitable material 5 is provided in the igniter, charges inadvertently applied to the external housing might cause current to flow through (and heat up) the bridge element and the pyrotechnic materials 4 , 5 because the external housing (including the disc closure 3) is electrically conductive. Thus, it may be desirable or necessary to electrically isolate the pyrotechnic materials 4, 5 from the external housing.

Another typical electrical pyrotechnic igniter is an axial igniter having a cylindrical housing and a header. The cylindrical (barrel-shaped) housing includes an end opening into which a conductive pyrotechnic material and then a non-conductive pyrotechnic material are loaded. The header has lead wires attached to a first end and a bridge element attached to a second end. The second end of the header is inserted into the housing containing the conductive and non-conductive pyrotechnic materials such that the bridge element contacts the non-conductive material and the header is sealed to the housing end opening. An opposite (second) end of the housing, opposite the first end opening, includes a weakened area. When current is conducted through the lead wires of the axial igniter and through the bridge element, the bridge element heats up, causing the pyrotechnic material to ignite. The pressure increase caused by ignition of the pyrotechnic material causes the weakened area to rupture in an axial direction that is parallel to the direction of insertion of the lead wires into the header.

SUMMARY

Both of the above igniters have a number of drawbacks addressed by the present disclosure. In particular, the coin-shaped igniter is manufactured using a housing with integral leads or posts, compacting the powder into the housing against the bridge element, and capping the assembly with a rupture disc. This approach results in free internal space within the interior of the housing that can allow the pyrotechnic material to separate or move away from the bridge element. When separation between the pyrotechnic material and bridge element occurs, the pyrotechnic material might not be ignited and thus, the igniter fails. Additionally, the coin-shaped igniter is more costly and inefficient when compared to the present disclosure in that the present disclosure allows for ease of lapping the glass (of the header) to a flat condition for the igniter.

A further problem associated with the axial (cylindrical) design, for example, is the increase in the axial length of the energetic device (a thermal battery, for example) in which it is installed. Specifically, by using an axial igniter where the rupture of the weakened area occurs in the axial direction, the length of the device (e.g., battery) is increased in order to accommodate the length of the igniter such that the weakened area is directed towards the device components that will be ignited and/or heated by the ignited pyrotechnic material expelled from the ruptured weakened area.

Additionally, typical pyrotechnic igniter housings and closure discs are mostly manufactured from stainless steel or gilding metal because the stainless steel or gilding metal does not fragment upon rupture of the weakened area. However, these materials do not provide the electrical insulation necessary to protect surrounding components from the current flowing through the lead wires into the housing. Thus, typical methods of insulating the igniter are to coat the interior of the housing or provide a sleeve to isolate the interior of the housing. However, the coating, for example, involves an increased cost to manufacture as it requires another step in the manufacturing process. Additionally, the coating is likely to be scraped off during installation or use of the igniter, resulting in unwanted current conduction. Similarly, manufacturing a sleeve to isolate the housing increases manufacturing costs and the sleeve may move during use or installation causing unwanted current conduction.

The manufacturing costs and insulation requirements as well as the need to decrease the size of the overall device into which the igniter is installed and to prevent movement of the pyrotechnic material dictate the need for an improved pyrotechnic igniter. Currently, pyrotechnic igniter designs include high manufacturing costs, increased axial length of the devices installed with the igniters, movement of the pyrotechnic material within the igniter resulting in failure of the igniter, and expensive insulation methods.

It would thus be advantageous to provide an igniter that allows for a decrease in both manufacturing costs and overall device length as well as improved insulation qualities and prevention of movement of the pyrotechnic material.

In accordance with one aspect of the invention, an igniter may include a housing having a first end, a second end opposite the first end, a longitudinal axis extending from the first end to the second end, and a top surface. The first end has an opening. The top surface has a weakened area. The igniter further includes a pyrotechnic material disposed within the housing, a header having a first end and a second end opposite the first end, and a bridge element provided on the first end of the header and having lead wires on the second end of the header. The first end of the header is inserted into the opening of the housing in a first direction so as to force the header against the pyrotechnic material. Flow of current through the bridge element heats the bridge element and ignites the pyrotechnic material, which causes the weakened area to rupture due to the increase in pressure caused by the ignited pyrotechnic material.

In some embodiments, the top surface of the housing extends in a plane substantially parallel to the longitudinal axis of the housing.

In some embodiments, when the weakened area ruptures, the ignited pyrotechnic material is expelled in a direction perpendicular to the longitudinal axis of the housing.

In some embodiments, the housing is composed of an aluminum alloy.

In some embodiments, the aluminum alloy is an anodized aluminum alloy. Because the anodized aluminum alloy is electrically-isolative, it is possible to use only conductive pyrotechnic material in the igniter.

In some embodiments, the housing has a hollow, rectangular cross-section in a plane perpendicular to the longitudinal axis.

In some embodiments, the second end of the housing is curved when viewed from above the top surface.

In some embodiments, the header, inserted into the housing, is sealed to the housing.

In some embodiments, the weakened area of the top surface has a reduced thickness compared to a remainder of the housing.

In some embodiments, the pyrotechnic material is a single type of pyrotechnic material.

In some embodiments, the single type of pyrotechnic material is electrically conductive.

In accordance with another aspect of the invention, a method of manufacturing an igniter may include providing an igniter housing having a first end, a second end opposite the first end, a longitudinal axis extending from the first end to the second end, and a top surface. The first end has an opening. The top surface has a weakened area. The method may further include loading a pyrotechnic material into the opening of the housing, inserting a header into the opening of the pre-filled housing in a first direction parallel to the longitudinal axis, pressing the bridge element of the header against the pyrotechnic material; and attaching the header to the housing. The header has a first end that is inserted into the housing, a second end opposite the first end, and a bridge element provided on the first end and having lead wires on the second end. When current flows through the bridge element, the bridge element is heated to ignite the pyrotechnic material, which ruptures the weakened area due to the increase in pressure caused by the ignited pyrotechnic material.

BRIEF DESCRIPTION OF THE DRAWINGS

Various exemplary embodiments of an igniter to which aspects of the invention are applied will be described in detail with reference to the following drawings in which.

DETAILED DESCRIPTION OF EMBODIMENTS

Exemplary embodiments of igniters to which aspects of the invention are applied are described below with reference to the figures in the context of energetic devices, such as thermal batteries. Additionally, the invention is applicable to any device that would benefit from an igniter having improved insulation qualities, decrease in one or both of manufacturing costs and overall device length, and prevention of movement of the pyrotechnic material.

Figure 2:
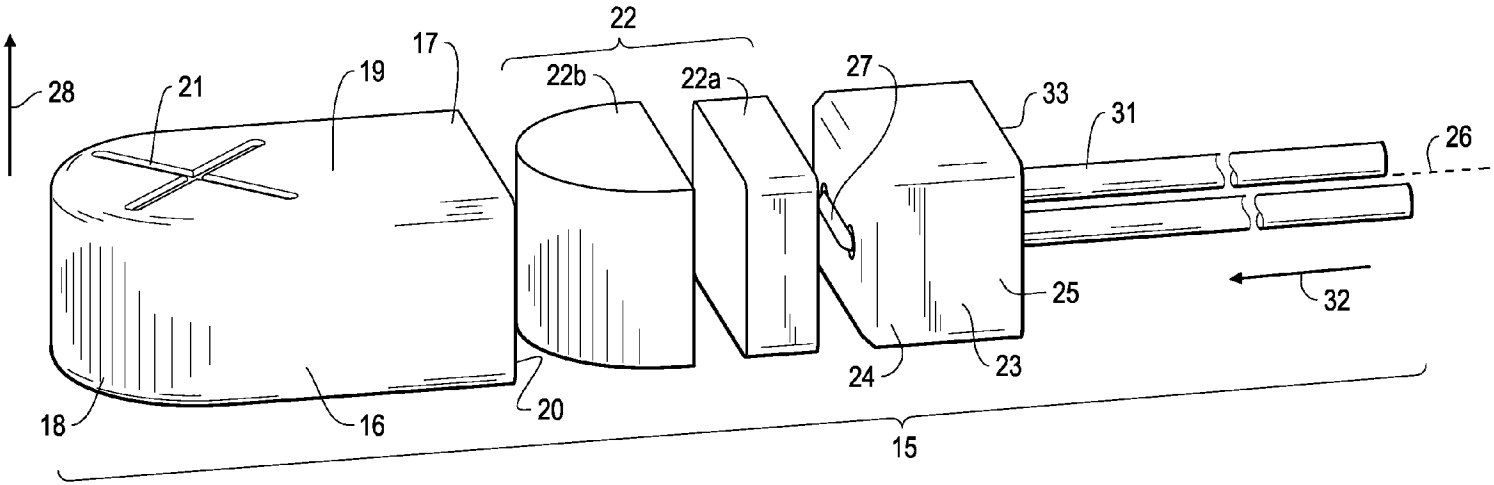
FIG. 2 is a perspective view of an exemplary embodiment of an igniter according to aspects of the invention with the pieces separated.

FIG. 2 is a perspective view of an exemplary embodiment of an igniter 15 with the pieces separated, The igniter 15 incorporates a housing 16, pyrotechnic material 22, header 23, and lead wires 31. In this exemplary embodiment, the housing 16 includes a top surface 19 having a weakened area 21. The weakened area 21 can be formed by one or more regions of locally induced stress concentration achieved by thinning of the top surface 19, a controlled notch, or any other method that allows for an increase in pressure within the housing 16 to cause the weakened area 21 to rupture, as discussed below.

Figure 3:
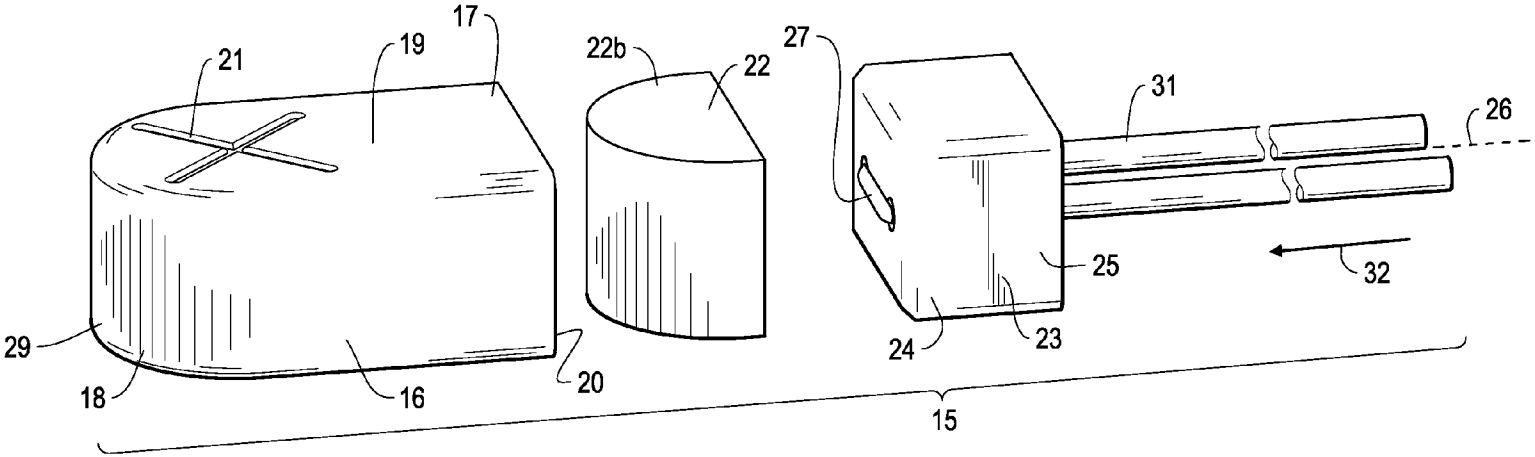
FIG. 3 is a perspective view of another exemplary embodiment of an igniter according to aspects of the invention with the pieces separated.

The header 23 includes a first end 24 and a second end 25 opposite the first end 24. The header 23 is formed from a metal portion 23*a* that surrounds a glass portion 23*b* (see FIG. 6). The first end 24 of the header 23 is closest to an opening 20 of the housing 16 prior to insertion of the header 23 into the opening 20. Lead wires 31 are mechanically fastened to the header 23 in such a way as to permit the conduction of electricity between the lead wires 31 external to the igniter 15 through the header 23 to the bridge element 27 attached between the ends of the conductors. The lead wires 31 extend along a longitudinal axis 26 of the igniter 15. The longitudinal axis 26 extends from a first end 17 of the housing 16 to a second end 18 of the housing 16. The first end 17 of the housing 16 is opposite from the second end 18, as illustrated in FIGS. 2 and 3.

The header 23 further includes a bridge element 27 provided on the first end 24 of the header 23. The bridge element 27 is provided at to the first end 24 of the header 23 and attached to ends of the lead wires 31. Current is supplied to the lead wires 31 external to the igniter 15 and conducted along the length of the lead wires 31 such that the current flows through the bridge element 27 causing the bridge element 27 to heat up. The bridge element 27 is a resistive element such as a metal wire or foil.

Figure 4:
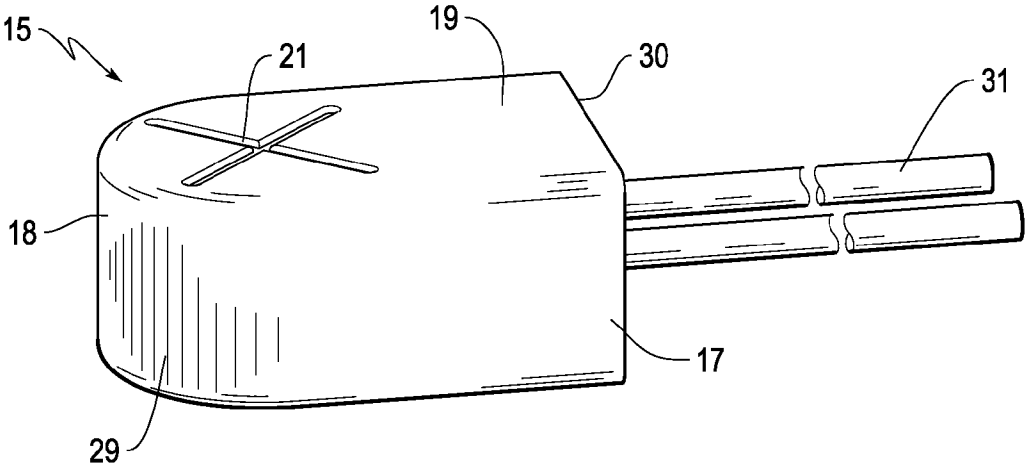
FIG. 4 is a perspective view of the igniter of FIGS. 2 or 3 when assembled.
Figure 5:
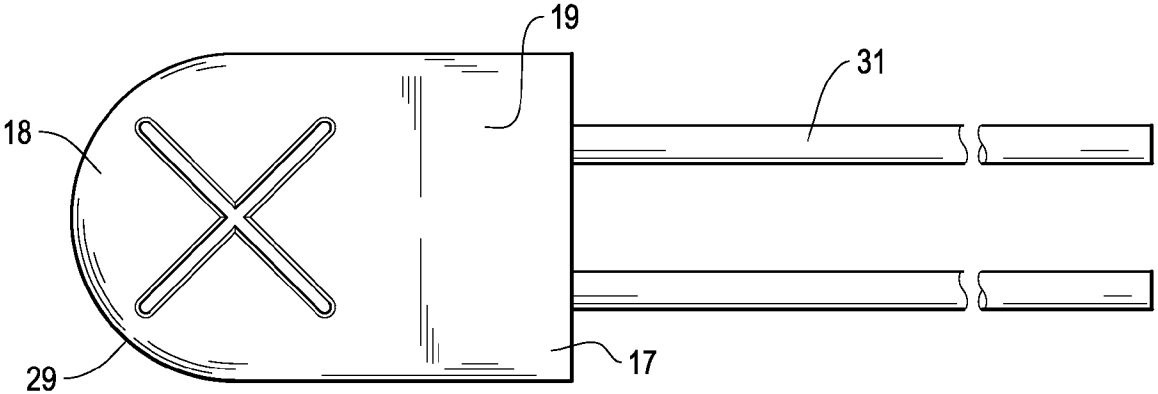
FIG. 5 is a top view of the FIG. 4 igniter.
Figure 6:
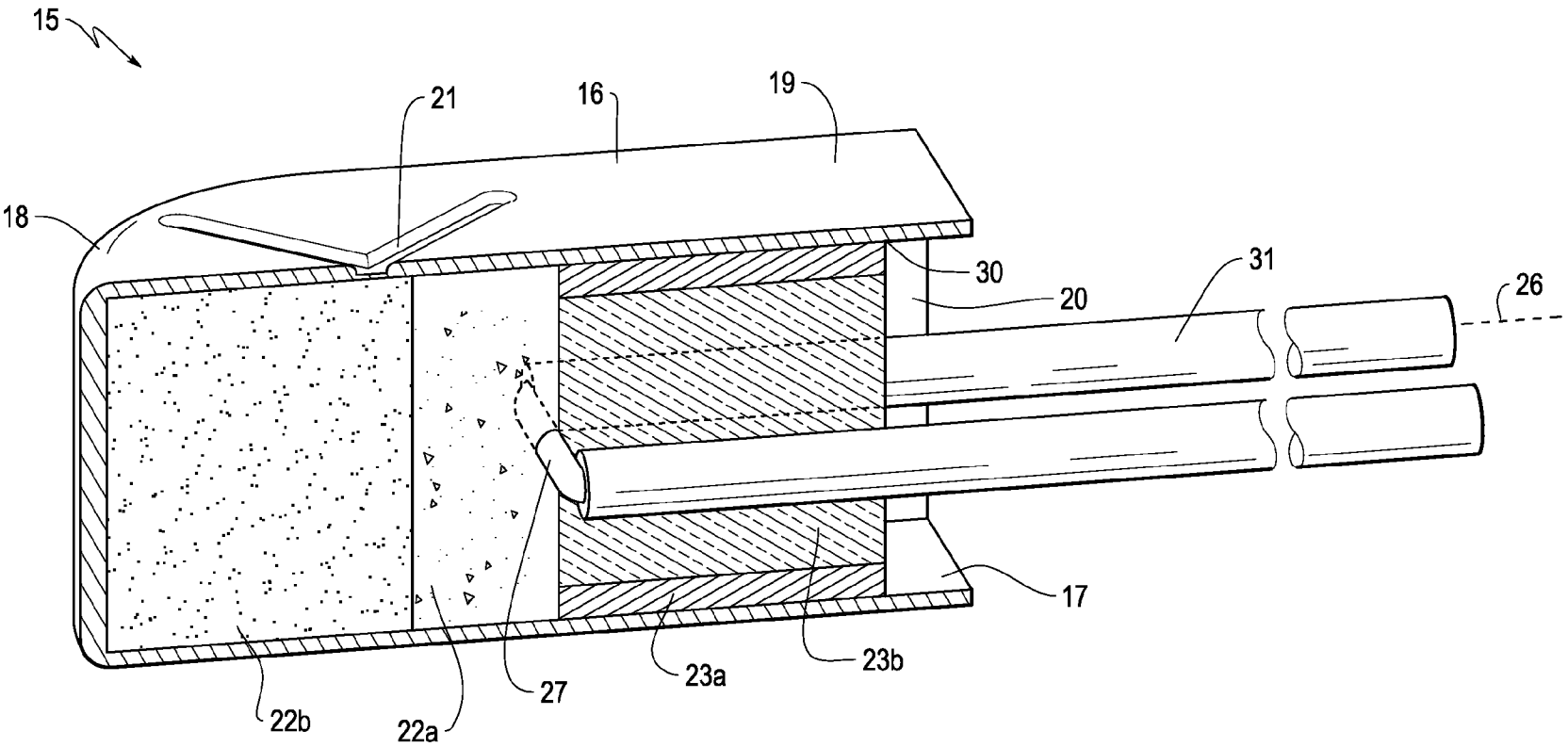
FIG. 6 is a cross-sectional view of the FIG. 4 igniter.

As illustrated in FIGS. 4-6, the pyrotechnic material 22 is loaded into the housing 16 such that the pyrotechnic material 22 is disposed within the housing 16 and contacts the bridge element 27. FIG. 2 illustrates an exemplary embodiment in which an electrically conductive pyrotechnic material 22*b* is first loaded into the housing 16 to be followed by the loading of an electrically non-conductive pyrotechnic material 22*a*. FIG. 3 illustrates an exemplary embodiment in which only an electrically conductive pyrotechnic material 22*b* is loaded into the housing 16.

After the pyrotechnic material 22 has been disposed within the housing 16, the first end 24 of the header 23 is inserted into the housing opening 20 and the header 23 is moved in a first direction 32, thus forcing the header 23 against the pyrotechnic material 22 (FIG. 6). The first direction 32 is a direction parallel to the longitudinal axis 26 of the housing 16. As illustrated in FIG. 4, the header 23 is sealed to the housing 16 by seal 30. The seal 30 between the header 23 and housing 16 can be formed by welding the header 23 to the housing 16, but the invention is not limited to this configuration. The seal 30 between the header 23 and the housing 16 can be formed by any means that prevents separation of the header 23 from the housing 16. The housing 16 could be crimped to the header 23, for example. Additionally, the header 23 is only inserted by an amount as needed into the housing 16. In other words, the header 23 does not have to be completely disposed within the housing 16. Instead, the portion of the header 23 disposed within the housing 16 need only be that amount of the header 23 that includes the bridge element 27 and any additional portion of the header 23 that is required to pack the pyrotechnic material 22 within the housing 16, as discussed below.

The insertion of the header 23 into the housing 16 in the first direction 32 (along the longitudinal axis 26) compacts the pyrotechnic material 22 within the housing 16 and prevents movement of the pyrotechnic material 22 away from the bridge element 27 of the header 23. More specifically, when the header 23 is inserted in the first direction 32, the header 23 compacts the pyrotechnic material 22 within the housing 22 until the header 23 can no longer be moved in the first direction 32. Thus, the header 23 has forced the pyrotechnic material 22 to substantially fill every void and space within the housing 16 (FIG. 6). When substantially no void or space is present within the housing 16, the pyrotechnic material 22 is forced against the bridge element 27 of the header 23, which is disposed within the housing 16, and the pyrotechnic material 22 cannot move away from the bridge element 27 within the housing 16. By preventing the movement of the pyrotechnic material 22 and forcing the pyrotechnic material 22 against the bridge element 27, the igniter will not fail to ignite, as discussed above with respect to typical igniters where the igniter may fail due to movement of the pyrotechnic material away from the bridge element 27 within the housing. When the header 23 is properly disposed within the housing 16 such that the pyrotechnic material 22 cannot move within the housing 16, the header 23 is fixed to the housing 16 and sealed to the housing 16 as discussed above.

FIGS. 2-6 illustrate the weakened area 21 of the housing 16. As discussed above, the weakened area 21 is formed in the top surface 19 of the housing 16. The top surface 19 of the housing 16 preferably extends in a plane substantially parallel to the longitudinal axis 26 of the housing 16. As illustrated in FIG. 5, the weakened area 21 is formed closer to the second end 18 of the housing 16 than the first end 17 of the housing. Thus, when the header 23 is inserted into the housing 16 and the pyrotechnic material 22 is compacted within the housing 16, the pyrotechnic material 22 is disposed beneath the weakened area 21. When the igniter is used, a circuit that includes the lead wires 31 is closed to cause current to flow through the lead wires 31 and the bridge element 27. Because the bridge element 27 has a relatively high electrical resistance, current flow will cause the bridge element 27 to heat up. When the temperature of the bridge element has reached an ignition temperature of the pyrotechnic material 22, the pyrotechnic material 22 ignites. Ignition (combustion) of material 22 generates hot gases and high pressure within the housing 16, which cause the weakened area 21 to rupture and expel the hot gases and/or particles. The expulsion occurs in a direction 28 perpendicular to the longitudinal axis 26 of the housing 16. In other words, the weakened area 21 ruptures in the direction 28 (i.e., the rupture direction) perpendicular to the longitudinal axis 26 of the housing 16 (along which the lead wires 31 are disposed) and perpendicular to the first direction 32 in which the housing 16 is loaded.

The use of an igniter 15 that ruptures in a direction 28 perpendicular to the longitudinal axis 26 along which the lead wires 31 are disposed minimizes the dimension of the igniter in the rupture direction (direction 28). This allows for the construction of an energetic device (such as a thermal battery) that has a decreased axial length because the rupture direction usually must be parallel to the axial direction of such energetic devices. Typical cylindrical igniters rupture in a direction parallel to the direction in which the lead wires are disposed. These igniters require increased axial length of the device (e.g., a thermal battery) in order to accommodate the igniter, while at the same time positioning the weakened area such that the expulsion of hot gases and/or particles is directed to the component(s) that are to be affected by this expulsion. Thus, an advantage of the current invention is the rupture of the weakened area 21 in a direction perpendicular to the longitudinal axis 26. In addition, an igniter in accordance with the present invention is easier to manufacture than a coin-shaped igniter and can be made smaller in the rupture direction (direction 28) than the coin-shaped igniter. Furthermore, igniters according to the present invention more reliably maintain the pyrotechnic material in contact with the bridge element than do coin-shaped igniters.

Typical igniter housings are constructed from stainless steel or gilding metal, as discussed above, which requires the use of either an insulating coating or sleeve to prevent surrounding components from electrically conducting with the housing. However, as previously discussed, there are a number of disadvantages to the use of stainless steel or gilding metal. Thus, in an exemplary embodiment, the material used to manufacture the housing 16 is an aluminum alloy and, in particular, an anodized aluminum alloy. Aluminum alloys and anodized aluminum alloys are electrically-isolative and thus, isolate the igniter 15 from the surrounding components. Aluminum also allows for significant deformation beyond the yield point without fragmenting upon rupture of the weakened area 21. The use of these materials for the housing 16 allows for the elimination of the electrically non-conductive pyrotechnic material 22*a* disposed within the housing 16, as illustrated in FIG. 3 where only an electrically conductive pyrotechnic material 22*b* is disposed within the housing 16. Because the electrically non-conductive material 22*a* functions as further electrical insulation, the use of aluminum alloy or anodized aluminum alloy as the material for the housing 16 eliminates the need for further insulation by this electrically non-conductive material 22*a*. This is because any external electric shocks will not be transmitted through the housing 16 to the bridge element 27, and thus the pyrotechnic material 22 will not be unintentionally heated.

Figure 1:
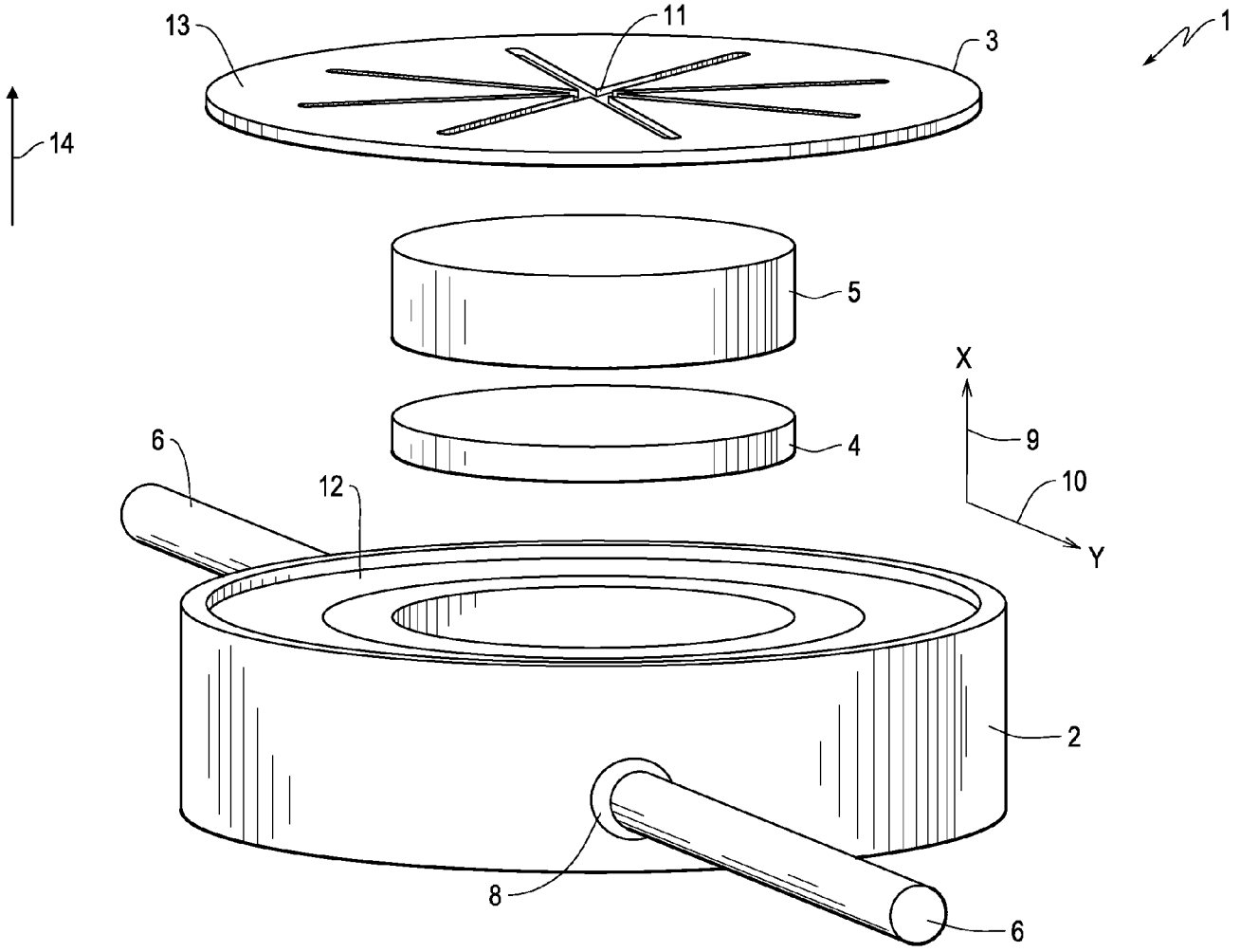
FIG. 1 is a perspective view of a traditional coin-shaped igniter.

In addition, the construction of the igniter 15, as discussed above, significantly reduces the cost of manufacturing the igniter 15 when compared to the costs of many typical igniters. Specifically, a coin-shaped igniter as illustrated in FIG. 1 is very costly to manufacture. The coin-shaped igniter requires that the pyrotechnic material be loaded inline with the direction of rupture and a closure disc be welded onto the top of the housing. Igniters in accordance with aspects of the invention have the advantage of reducing the cost of manufacturing by eliminating the need for a coating or sleeve. In addition, the geometry of the igniter 15 allows for high volume, low cost manufacturing techniques.

The pyrotechnic material 22 loaded within the housing 16 can be any known material that would combust when contacted with a heated bridge element. Additionally, the pyrotechnic material 22 can be in any form. The above described invention utilizes the pyrotechnic material 22 in a powder form but the invention is not limited to powder-form pyrotechnic material. Instead, the pyrotechnic material 22 can be any form that allows for the axial loading of the pyrotechnic material 22 into the housing 16.

The housing 16 has a hollow, rectangular cross-section in the plane perpendicular to the longitudinal axis 26. FIGS. 2 and 3 illustrate the housing 16 prior to insertion of the pyrotechnic material 22. FIG. 6 illustrates that the cross-section of the housing 16 is rectangular and, prior to the insertion of the pyrotechnic material and header, is hollow. Further, the second end 18 of the housing 16 can be curved when viewed from the top surface 19. The curve 29 at the second end 18 of the housing 16 causes the housing 16 to have a "tombstone" shape.

Figure 7:
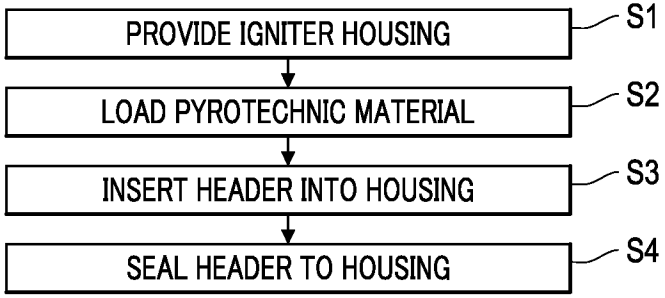
FIG. 7 is a flowchart of an exemplary embodiment of the invention illustrating a method of manufacturing the igniter.

A method of manufacturing the igniter 15 according to an exemplary embodiment is now described. As illustrated in FIG. 7, an igniter housing 16 is provided (step S1) such that the igniter housing includes the features discussed above. The pyrotechnic material 22 is loaded into the opening 20 of the housing 16 (step S2). The header 23 is then inserted into the pre-filled housing 16 (step S3) in the direction 32 parallel to the longitudinal axis 26 and the header includes the features discussed above. The bridge element 27 (disposed on the first end 24 of the header 23) is pressed against the pyrotechnic material 22. The header 23 is pressed into the housing 16 until the pyrotechnic material 22 is compacted within the housing, such that substantially no voids or spaces exist within the housing 16. The header 23 is then sealed to the housing 16 via, for example, welding (step S4).

The illustrated exemplary embodiments of the igniter as set forth above are intended to be illustrative and not limiting. Various changes may be made without departing from the spirit and scope of the invention.

What is claimed is:

1. An igniter comprising:

a housing having a first end, a second end opposite the first end, a longitudinal axis extending from the first end to the second end, a housing side wall, a bottom wall, and a top wall with a top surface, the first end having an opening, the top wall in contact with the housing side wall, the housing side wall extending around the second end, the bottom wall in contact with the housing side wall, and the top surface having a weakened area;

a pyrotechnic material disposed within the housing;

a header having a first end and a second end opposite the first end, the first end of the header being inserted into the opening of the housing in a first direction so as to force the header against the pyrotechnic material; and a bridge element provided on the first end of the header and having lead wires on the second end of the header, wherein flow of current through the bridge element heats the bridge element and ignites the pyrotechnic material, which causes the weakened area to rupture, and the housing has a hollow, rectangular cross-section in a plane perpendicular to the longitudinal axis.

2. The igniter according to claim 1, wherein the top surface of the housing extends in a plane substantially parallel to the longitudinal axis of the housing.

3. The igniter according to claim 2, wherein, when the weakened area ruptures, the ignited pyrotechnic material is expelled in a direction perpendicular to the longitudinal axis of the housing.

4. The igniter according to claim 1, wherein the housing is composed of an aluminum alloy.

5. The igniter according to claim 4, wherein the aluminum alloy is an anodized aluminum alloy.

6. The igniter according to claim 1, wherein the second end of the housing is curved when viewed from above the top surface.

7. The igniter according to claim 1, wherein the header, inserted into the housing, is sealed to the housing.

8. The igniter according to clam 1, wherein the weakened area of the top surface has a reduced thickness compared to a remainder of the housing.

9. The igniter according to claim 1, wherein the pyrotechnic material is a single type of pyrotechnic material.

10. The igniter according to claim 9, wherein the single type of pyrotechnic material is electrically conductive.

11. The igniter according to claim 1, wherein the housing with the top surface is configured to direct the rupture of the weakened area in only one direction; and the pyrotechnic material is in direct contact with the weakened area before rupture.

12. A method of manufacturing an igniter, the method comprising:

providing an igniter housing, the igniter housing having a first end, a second end opposite the first end, a longitudinal axis extending from the first end to the second end, a housing side wall, a bottom wall, and a top wall with a top surface, the first end having an opening, the top wall in contact with the housing side wall, the housing side wall extending around the second end, the bottom wall in contact with the housing side wall ,and the top surface having a weakened area;

loading a pyrotechnic material into the opening of the housing;

inserting a header into the opening of the pre-filled housing in a first direction parallel to the longitudinal axis, the header having a first end that is inserted into the housing, a second end opposite the first end, and a bridge element provided on the first end and having lead wires on the second end;

pressing the bridge element of the header against the pyrotechnic material within the housing; and attaching the header to the housing, wherein when current flows through the bridge element, the bridge element is heated to ignite the pyrotechnic material, which ruptures the weakened area, and the housing has a hollow, rectangular cross-section in a plane perpendicular to the longitudinal axis.

13. The method according to claim 12, wherein the top surface of the housing extends in a plane substantially parallel to the longitudinal axis of the housing.

14. The method according to claim 13, wherein, when the weakened area ruptures, the ignited pyrotechnic material is expelled in a direction perpendicular to the first direction.

15. The method according to claim 12, wherein the housing is composed of an aluminum alloy.

16. The method according to claim 15, wherein the aluminum alloy is an anodized aluminum alloy.

17. The method according to claim 12, wherein the second end of the housing is curved when viewed from above the top surface.

18. The method according to claim 12, wherein the weakened area of the top surface has a reduced thickness compared to surrounding areas of the housing.

19. The igniter according to claim 12, wherein the igniter housing with the top surface is configured to direct the rupture of the weakened area in only one direction; and the pyrotechnic material is in direct contact with the weakened area before rupture.

* * * * *